US009388825B1

(12) United States Patent
Behbehani

(10) Patent No.: US 9,388,825 B1
(45) Date of Patent: Jul. 12, 2016

(54) VENTILATION FAN WITH AUTOMATIC BLADE CLOSURE MECHANISM

(71) Applicant: Fawzi Q. M. A. O. A. Behbehani, Salwa (KW)

(72) Inventor: Fawzi Q. M. A. O. A. Behbehani, Salwa (KW)

( * ) Notice: Subject to any disclaimer, the term of this patent is extended or adjusted under 35 U.S.C. 154(b) by 0 days.

(21) Appl. No.: 14/879,062

(22) Filed: Oct. 8, 2015

(51) Int. Cl.

| | |
|---|---|
| ***F04D 29/36*** | (2006.01) |
| ***F04D 25/14*** | (2006.01) |
| ***F24F 7/007*** | (2006.01) |
| ***F24F 7/013*** | (2006.01) |
| ***F24F 13/06*** | (2006.01) |

(52) U.S. Cl.
CPC ..... *F04D 29/36* (2013.01); *F04D 25/14* (2013.01); *F04D 29/362* (2013.01); *F24F 7/007* (2013.01); *F24F 7/013* (2013.01); *F24F 13/06* (2013.01)

(58) Field of Classification Search
CPC ..... F04D 25/14; F04D 29/36; F04D 29/362; F04D 29/368; F24F 7/007; F24F 7/013; F24F 13/06; F24F 13/142
See application file for complete search history.

(56) References Cited

U.S. PATENT DOCUMENTS

| | | | | |
|---|---|---|---|---|
| 2,656,971 | A * | 10/1953 | Mader | F04D 29/364 415/123 |
| 3,096,827 | A * | 7/1963 | Woods | F01P 7/06 416/39 |
| 4,913,623 | A | 4/1990 | Schilling et al. | |
| 5,470,205 | A | 11/1995 | Conklin, Jr. | |
| 6,019,678 | A | 2/2000 | Takahashi | |
| 7,326,108 | B2 * | 2/2008 | Matthews | F24F 7/065 454/259 |
| 8,007,228 | B2 * | 8/2011 | Wang | F04D 25/0613 415/146 |
| 8,025,481 | B2 | 9/2011 | Foxworth | |
| 2012/0027593 | A1 | 2/2012 | DeLeon | |

FOREIGN PATENT DOCUMENTS

| | | |
|---|---|---|
| EP | 413663 | 2/1991 |
| GB | 1127604 | 9/1968 |

OTHER PUBLICATIONS

Website, http://www.aliexpress.com/item/free-shipping-Small-feidiao-ventilation-fan-exhaustfan-ex . . . , small feidiao ventilation fan exhaust fan, twelve pages printed from the internet on Apr. 23, 2015.

* cited by examiner

*Primary Examiner* — Patrick Hamo
(74) *Attorney, Agent, or Firm* — Richard C. Litman

(57) ABSTRACT

The ventilation fan with automatic blade closure mechanism can include pivotable fan blades extending radially from a central hub. The fan blades pivot on their spars to allow the blades to assume positive pitch angles during operation. The fan blades are urged to a flat, substantially coplanar configuration when the fan is not in operation. A mechanism drives a motor shaft, the fan hub, and the blades axially outward for operation, and retracts the shaft, hub, and blades when the fan is not in operation. The tips of the blades seat in a groove of the surrounding rim when the fan is not in operation, with the outer surfaces of the blades, hub, and surrounding rim forming a substantially flat, continuous surface. This surface can be embellished with a decorative display, providing the fan with an attractive appearance when the fan is not in operation.

14 Claims, 12 Drawing Sheets

VENTILATION FAN WITH AUTOMATIC BLADE CLOSURE MECHANISM

BACKGROUND OF THE INVENTION

1. Field of the Invention

The present invention relates generally to ventilation devices and systems, and particularly to a ventilation fan with an automatic blade closure mechanism. The mechanism adjusts the blades to a substantially planar configuration when the fan is not in operation, thereby closing off airflow through the ventilation duct and permitting a decorative display to be applied to the essentially continuous surface of the coplanar blades.

2. Description of the Related Art

Built-in ventilation fans in bathrooms, kitchens, and other areas of homes and other structures are well known. Many such fans include some form of closure for the ventilation duct, to prevent relatively warmer or cooler air from flowing into or from the structure when the fan is not operating. These closure devices comprise various forms, e.g., louvers, single hinged panels, etc. These devices are nearly universally installed upon the exterior of the structure, with the blades and other components of the fan being clearly visible in the interior of the structure. At best, some form of grille or guard may be installed across the ventilation duct, primarily to prevent inadvertent contact with the fan while it is in operation.

All of these various fan configurations result in the ventilation duct and its fan, or at least some form of grille or guard, being visible from within the room where the system has been installed. While such a fan having a grille or guard thereover may not be particularly unsightly, it is nevertheless obtrusive and does not blend well with the interior décor of the typical home, office, or other non-industrial building structure.

Thus, a ventilation fan with automatic blade closure mechanism solving the aforementioned problems is desired.

SUMMARY OF THE INVENTION

The ventilation fan with automatic blade closure mechanism can be installed on or within a wall or other panel of a building structure. The fan includes various mechanisms for directing the blades to a positive pitch angle during operation to draw air through the fan, and for moving the blades to a flat pitch angle to form a substantially flat and continuous disc when the fan is not in operation. One of the mechanisms retracts the fan motor shaft, fan hub, and fan blades axially, seating the outer tips of the blades in a groove formed in a surrounding rim when the fan is not in operation. This mechanism also extends the fan motor shaft, fan hub, and fan blades axially to unseat the blade tips from the outer rim during fan operation, which axial adjustment also allows the fan blades to automatically adjust to a positive pitch angle when clear of the surrounding rim.

As the blades adjust to their flat pitch setting when the fan is inoperative, all of the blades lie in substantially the same plane, with the chords of the blades also lying in a single plane. The blades retract axially due to the retraction of the fan motor shaft and hub when the fan is not in operation, with the outer surfaces of the blades disposed substantially coplanar with the outer surface of the surrounding rim. This uniform surface permits the application of a decorative display over the fan blades, the hub, and the outer rim, if so desired, thereby providing an attractive display when the fan is not in operation.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The ventilation fan with automatic blade closure mechanism provides for the substantially complete closure of the surrounding ventilation duct opening when the fan is not in operation, thereby substantially preventing the flow of air through the duct. The closed blades form a substantially flat, continuous surface when the fan is not in operation, with this surface providing for the application of a decorative coating or display thereon.

Figure 1A:
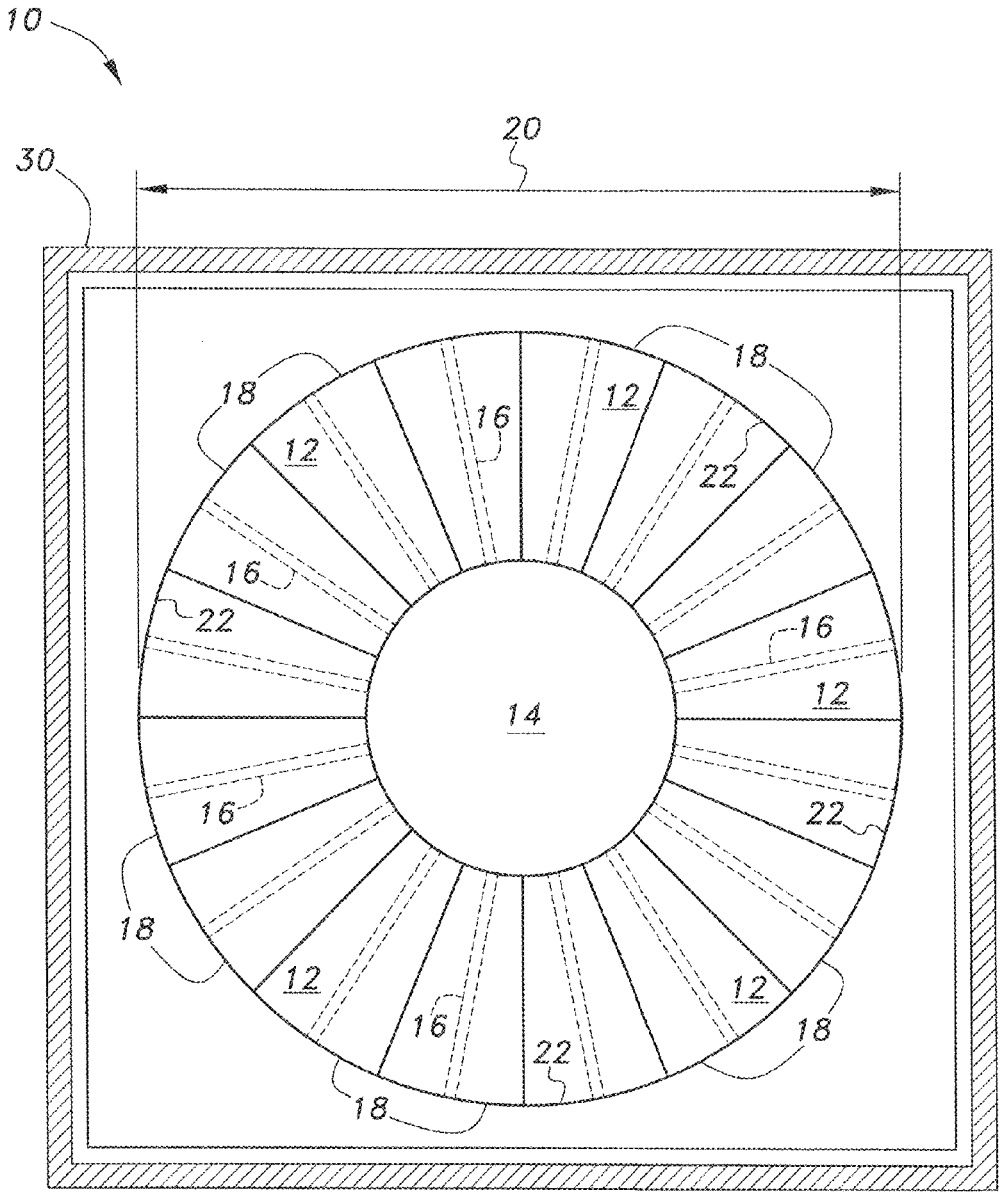
FIG. 1A is a front elevation view of a ventilation fan with automatic blade closure mechanism according to the present invention, showing the blades in their closed configuration.
Figure 1B:
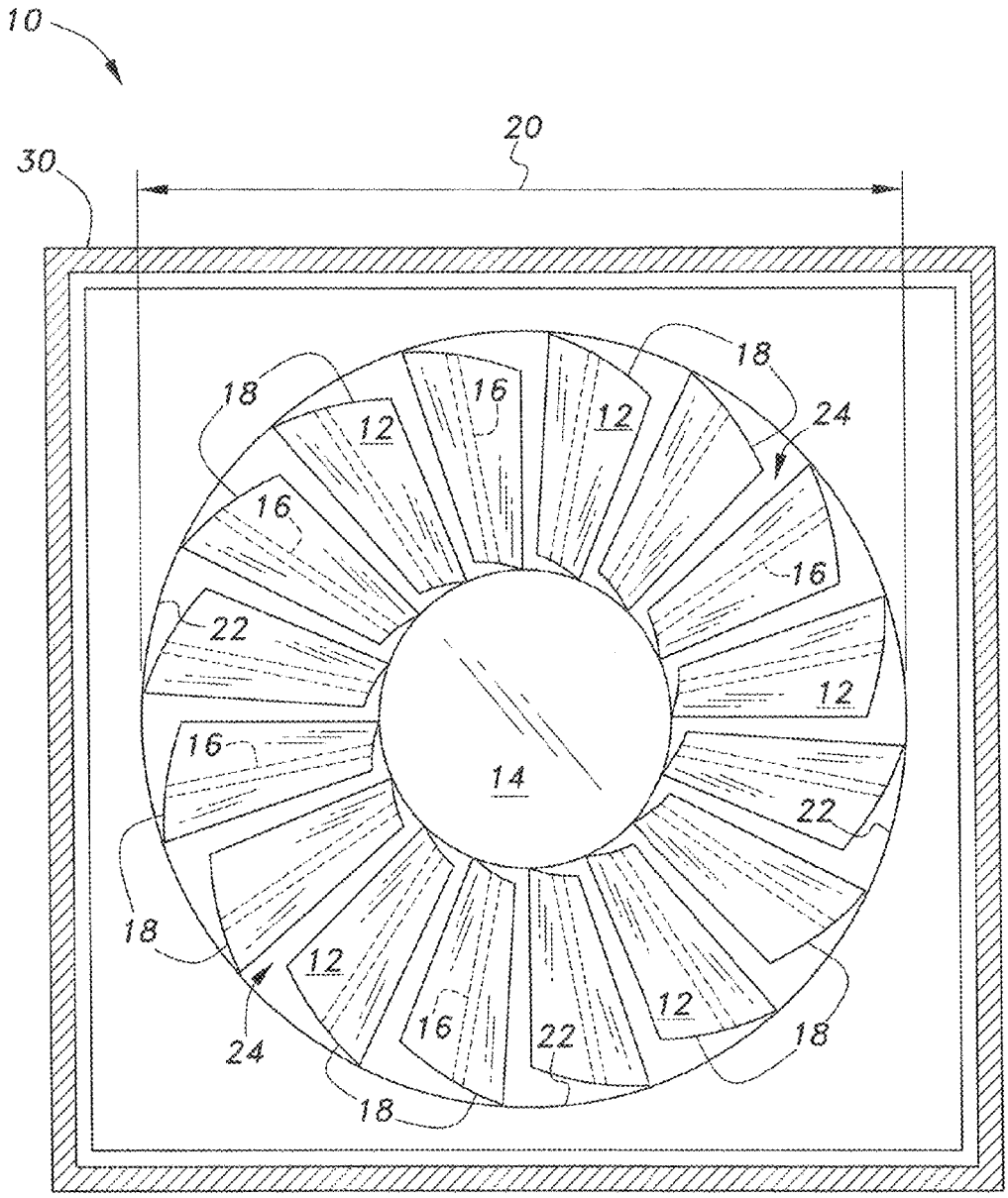
FIG. 1B is a front elevation view of the ventilation fan with automatic blade closure mechanism according to the present invention, showing the blades in their open configuration.
Figure 1C:
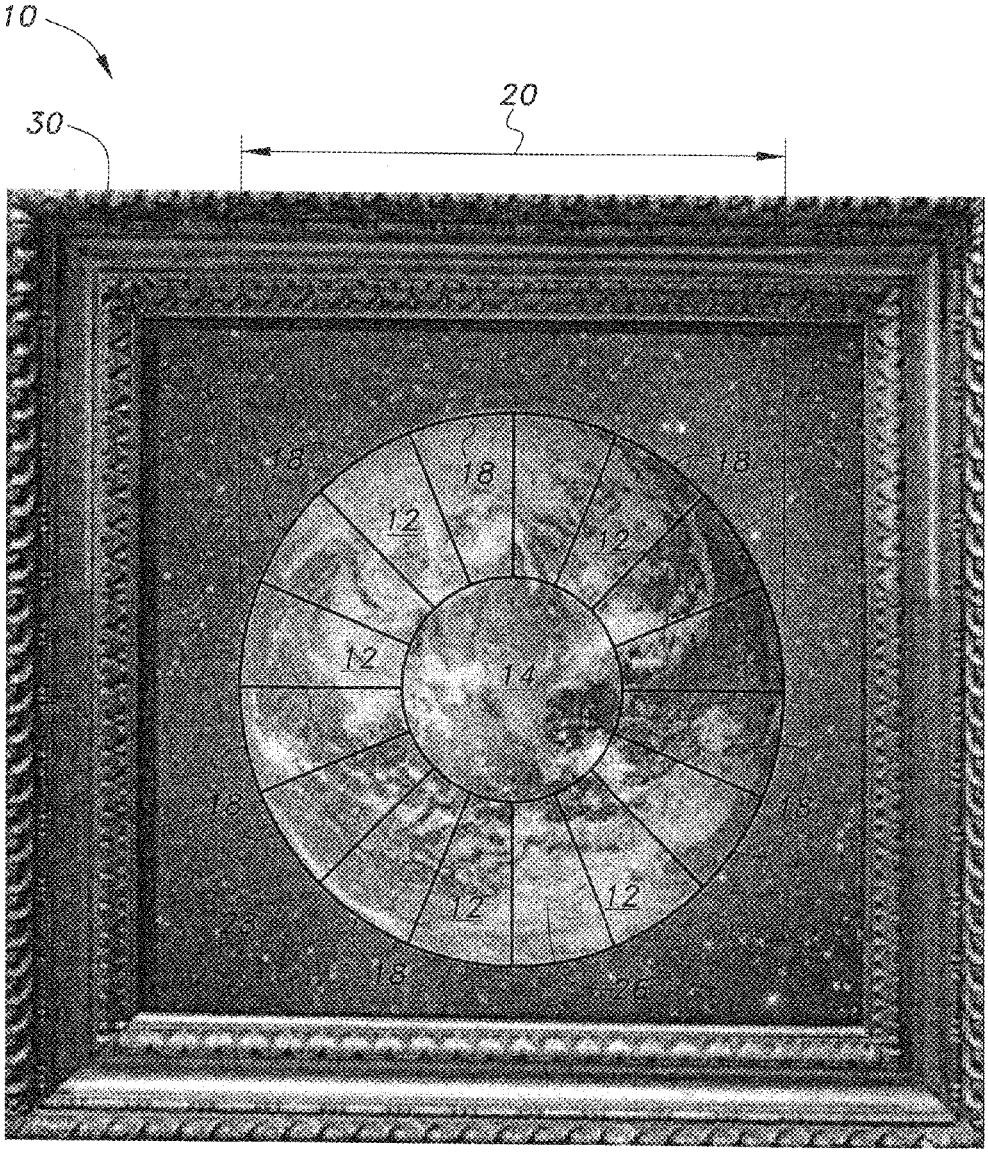
FIG. 1C is a front elevation view of an alternative embodiment of the ventilation fan with automatic blade closure mechanism according to the present invention, showing the blades in their closed configuration with a decorative pattern applied to the closed blades.

FIGS. 1A, 1B, and 1C provide front elevation views of the ventilation fan with blade closure mechanism 10, or ventilation fan or fan 10. The ventilation fan 10 includes a plurality of fan blades or blades 12, extending radially from a central hub 14. More specifically, a plurality of fan blade spars 16 extend radially from the hub 14, with each blade being attached to a corresponding spar 16. The spars 16 are pivotally attached in the hub 14, thus allowing the blades 12 to adjust in pitch within limits, described further below.

Each blade 12 has a blade tip 18. The blades 12 are surrounded by a stationary rim 22 defining a vent opening 24 (FIG. 1B) having a diameter substantially equal to a fan diameter 20. As the blades 12 move to a flat pitch and collectively lie in a single plane when the fan 10 is inoperative, they and the hub 14 form a substantially continuous surface to close the vent opening 24 when the fan 10 is not operating. This substantially flat and continuous surface lends itself well to the application of a decorative unified display or pattern 26 thereon, e.g., the pictorial representation of the earth as seen from space, as shown in FIG. 1C. While the decorative pattern 26 need not be circular and congruent with the fan and vent opening diameter 20, such circular patterns or displays are well suited to the circular area subtended by the fan blades 12. Other round or non-round displays may be applied to the blades 12, hub 14, and the surrounding stationary field or background 28. Further embellishment may be provided for the display 26 by installing a decorative frame 30 or the like as a border or periphery for the stationary background 28, thus forming an effect closely resembling a fine work of art when the fan blades 12 are closed, as shown in FIG. 1A and particularly in FIG. 1C.

Figure 2A:
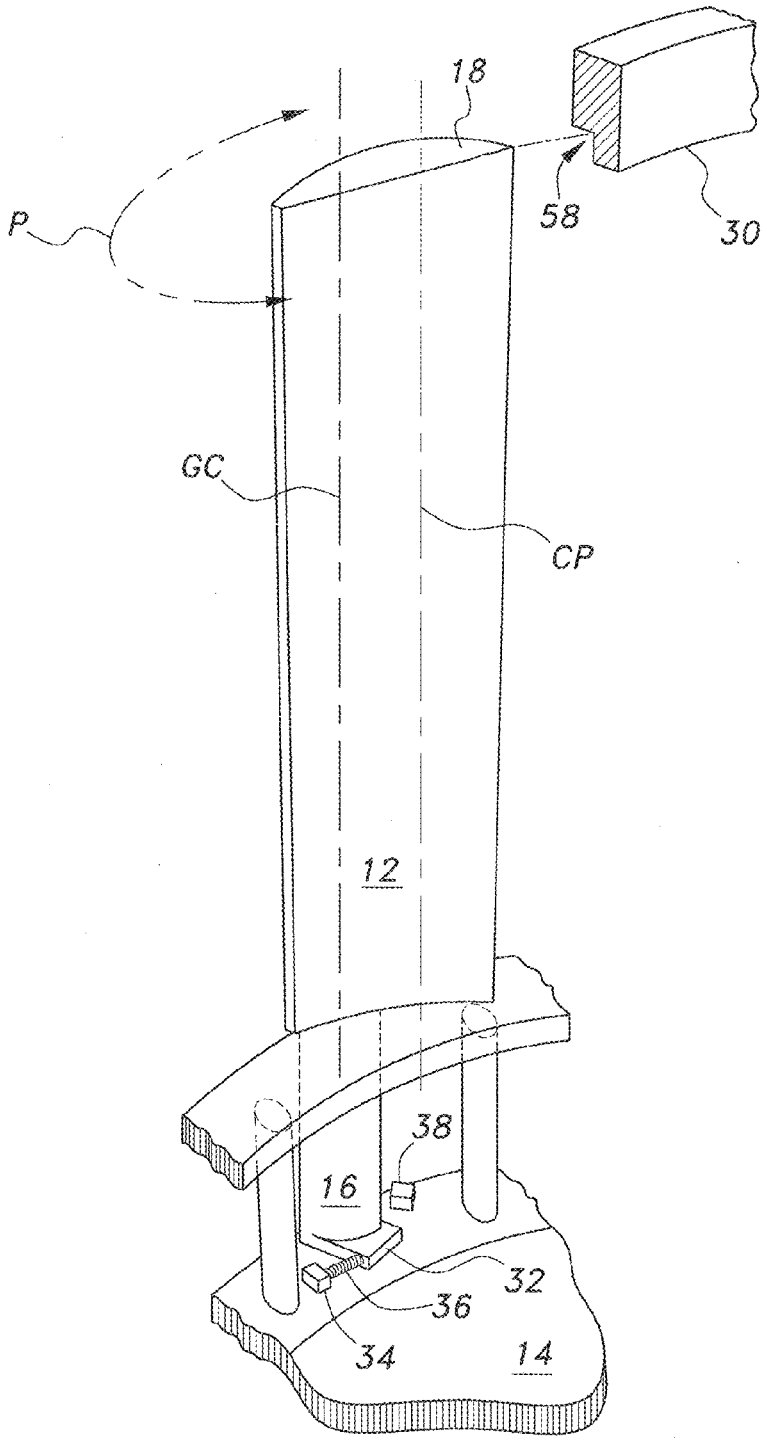
FIG. 2A is a detailed perspective view of a single fan blade of the ventilation fan with automatic blade closure mechanism according to the present invention, illustrating the automatic blade pitch adjustment mechanism.
Figure 2B:
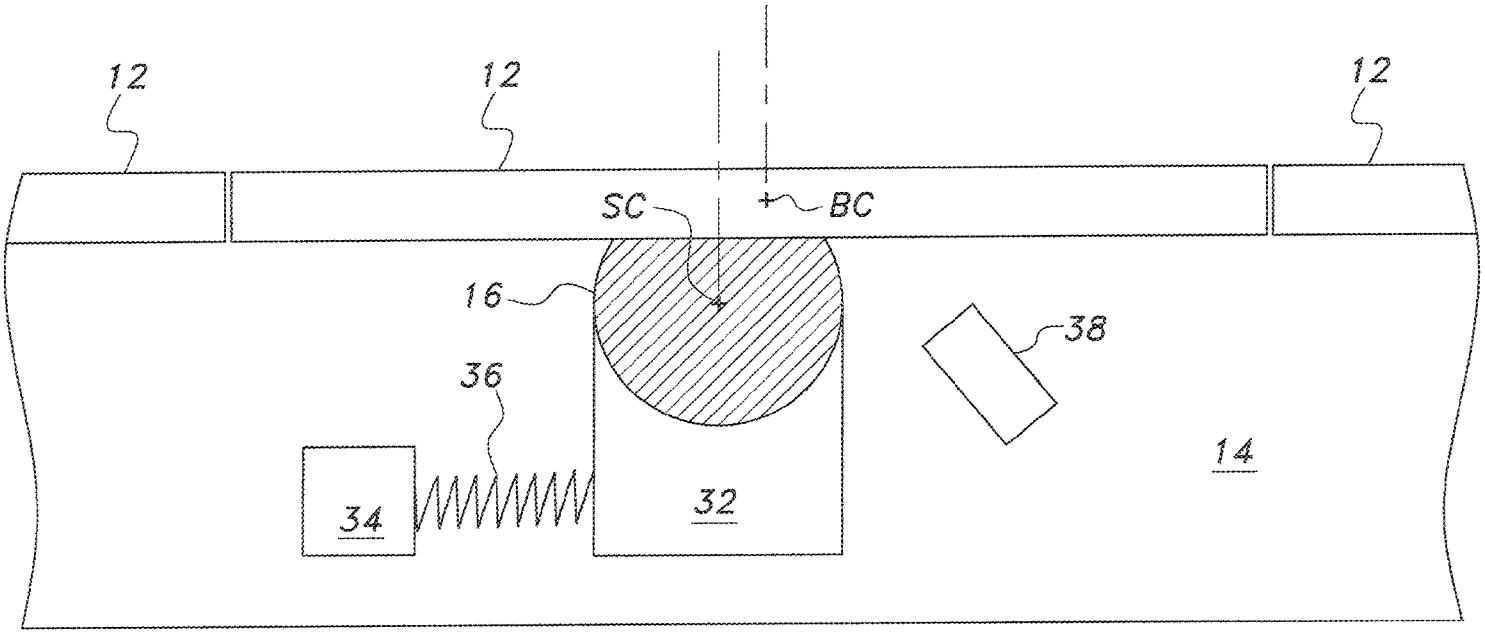
FIG. 2B is a detailed top plan view of a single fan blade of the ventilation fan with automatic blade closure mechanism according to the present invention, showing the blade in its flat or closed orientation as when the fan is inoperative.
Figure 2C:
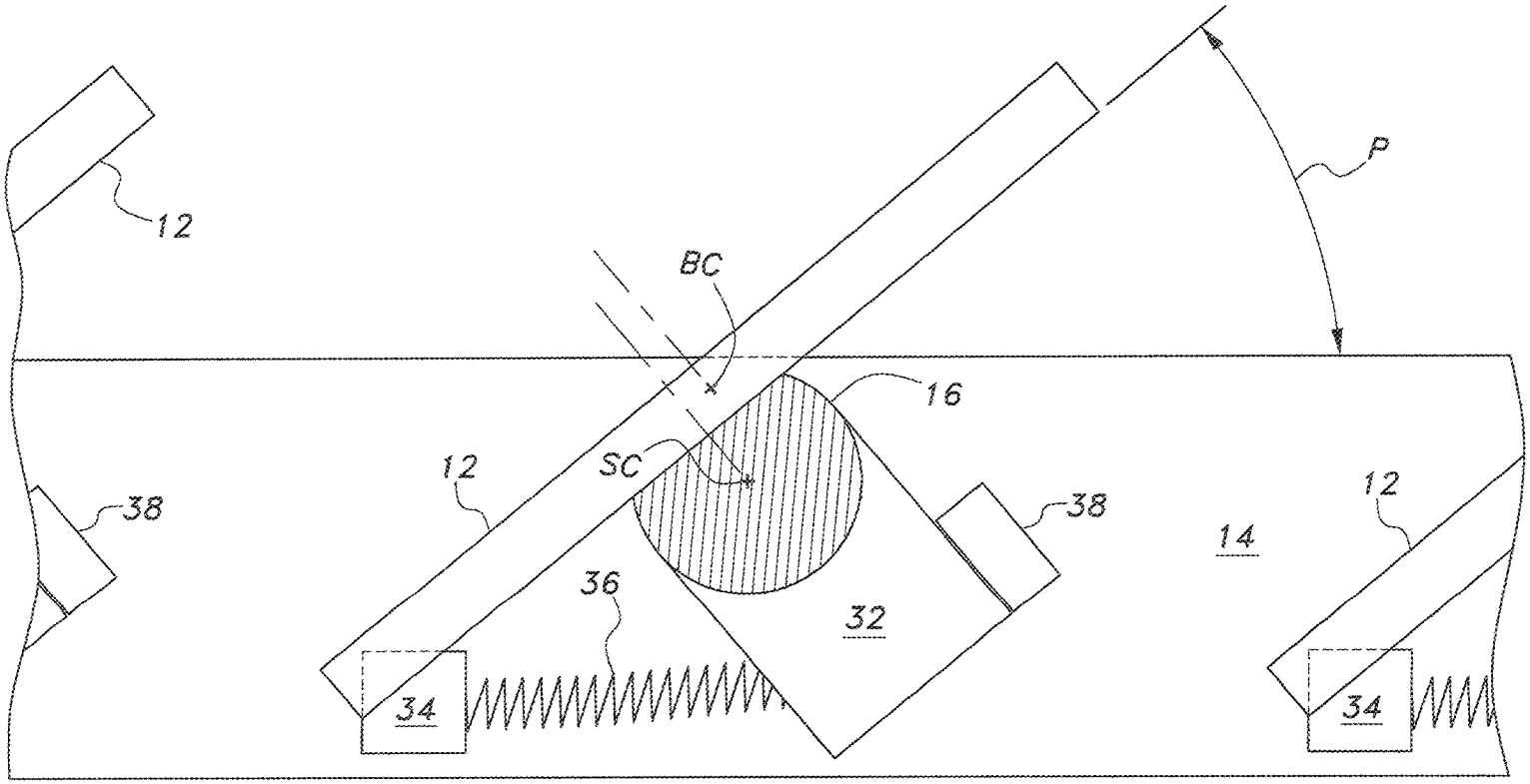
FIG. 2C is a detailed top plan view of a single fan blade of the ventilation fan with automatic blade closure mechanism according to the present invention, showing the blade in its positive pitch or open orientation as when the fan is operating.

FIGS. 2A, 2B, and 2C illustrate the automatic pitch changing operation of the fan blades 12, with a single exemplary blade 12 being shown in FIG. 2A. Each fan blade spar 16 has a root or base that is pivotally secured in the hub 14, allowing the spar 16 and its blade 12 to pivot about the elongate axis of the spar and blade assembly as shown by the pitch change arrows P in FIGS. 2A and 2C. Each spar 16 includes a spar extension 32 extending radially therefrom, adjacent to the hub 14. Spring attachment blocks 34 are installed on the hub 14, with one such block 34 for each blade 12. A tensile spring 36 is disposed between each block 34 and its spar extension 32, with this assembly urging the blade 12 to its fully closed, flat pitch orientation as shown in FIG. 2B.

If the blade 12 is formed to have some positive camber, as shown in FIG. 2A, the center of aerodynamic pressure CP (i.e., the "lift" or thrust developed by the blade) is forward of the geometric center GC of the blade during fan operation, thus urging the blade 12 to a positive angle of attack or open position, as shown in FIG. 2C, against the force of the tensile spring 36. (The blade 12 is shown as a flat, non-cambered surface in FIGS. 2B and 2C, as may be desirable for displaying a decorative pattern thereon.) The pivotal centers SC of the spars 16 may be located rearward of the blade geometric centers BC, i.e., the aerodynamic centers for flat, non-cambered blades, in order to enhance this positive pitch tendency, as shown in FIGS. 2B and 2C. Pitch limiting stop blocks 38 are provided on the hub 14, to limit the maximum pitch of the blades 12. The stop blocks 38 may be located to limit the maximum blade pitch to any desired angle, e.g., 40 degrees, or other maximum pitch angle as desired. Thus, the blades 12 will tend to form a flat, substantially continuous surface due to the force of the tensile springs 36 when the fan 10 is not in operation, but will automatically deploy to a positive pitch due to their forwardly disposed aerodynamic centers when the fan is in operation.

Figure 3A:
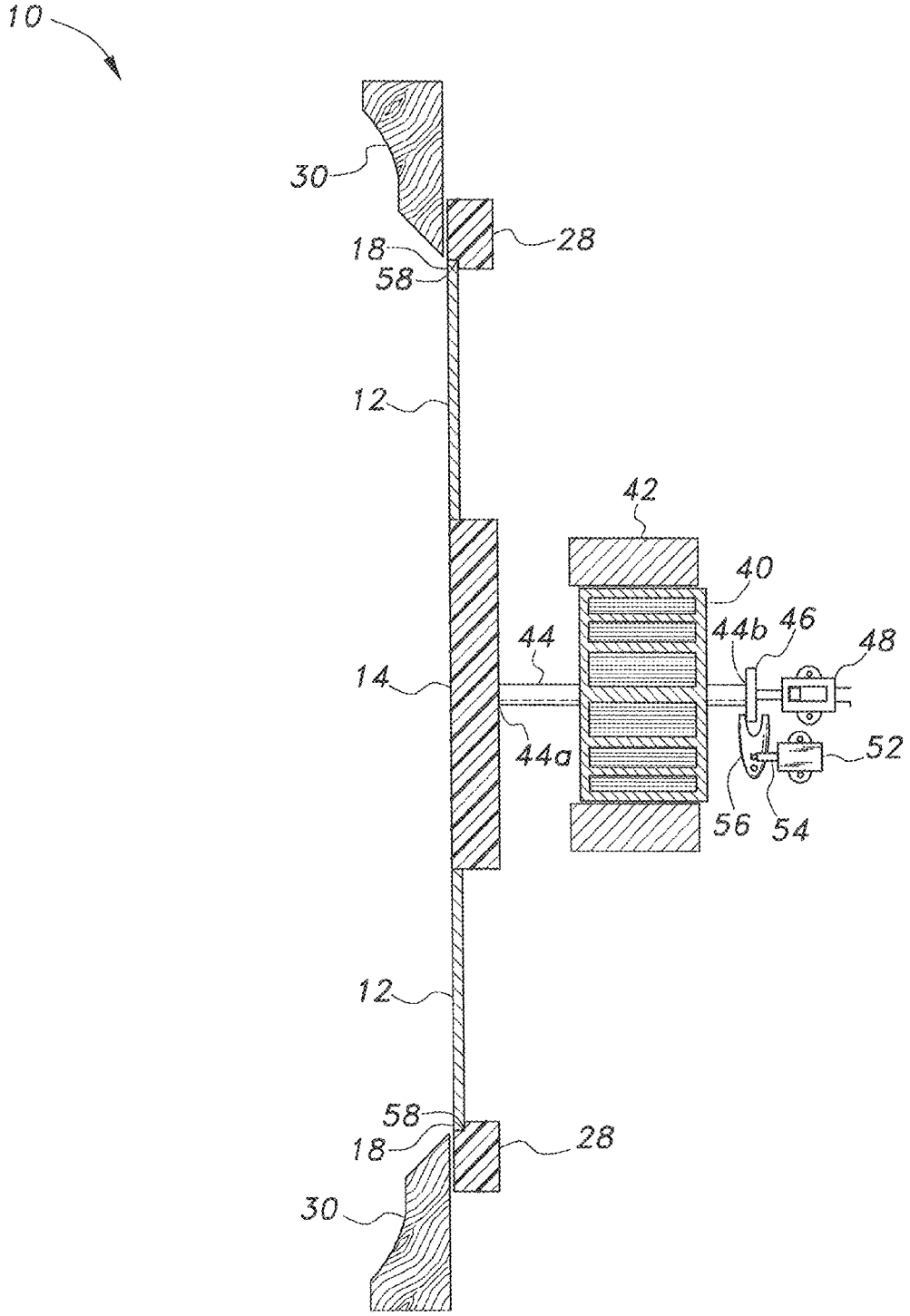
FIG. 3A is a side elevation view of the motor, fan, and shaft control mechanism of the ventilation fan with automatic blade closure mechanism according to the present invention, showing the fan blades adjusted to their flat pitch or closed orientation by the mechanism and seated in the surrounding outer rim.
Figure 3B:
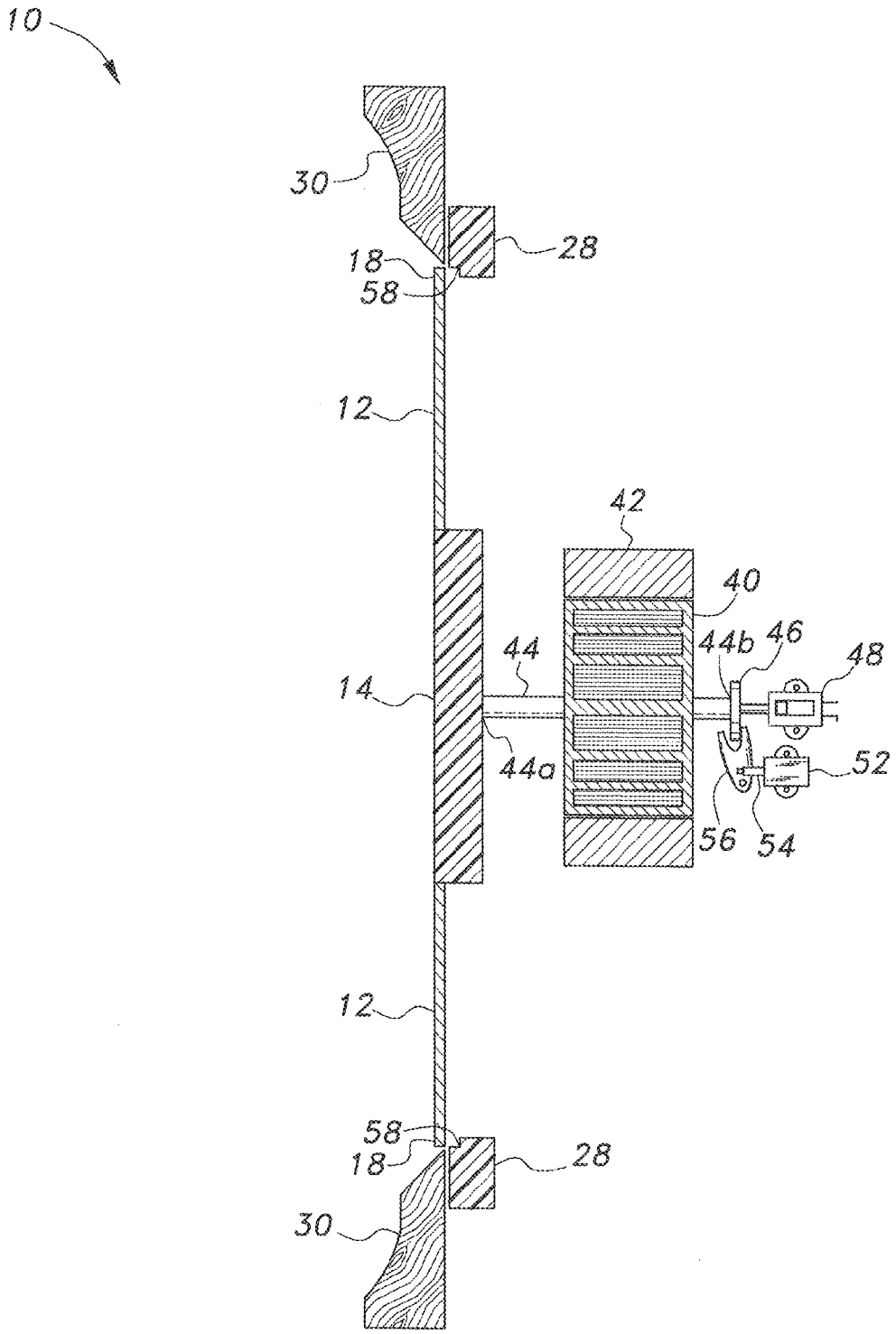
FIG. 3B is a side elevation view of the motor, fan, and shaft control mechanism of the ventilation fan with automatic blade closure mechanism according to the present invention, showing the flat fan blades adjusted by the mechanism to clear the surrounding outer rim or frame.
Figure 3C:
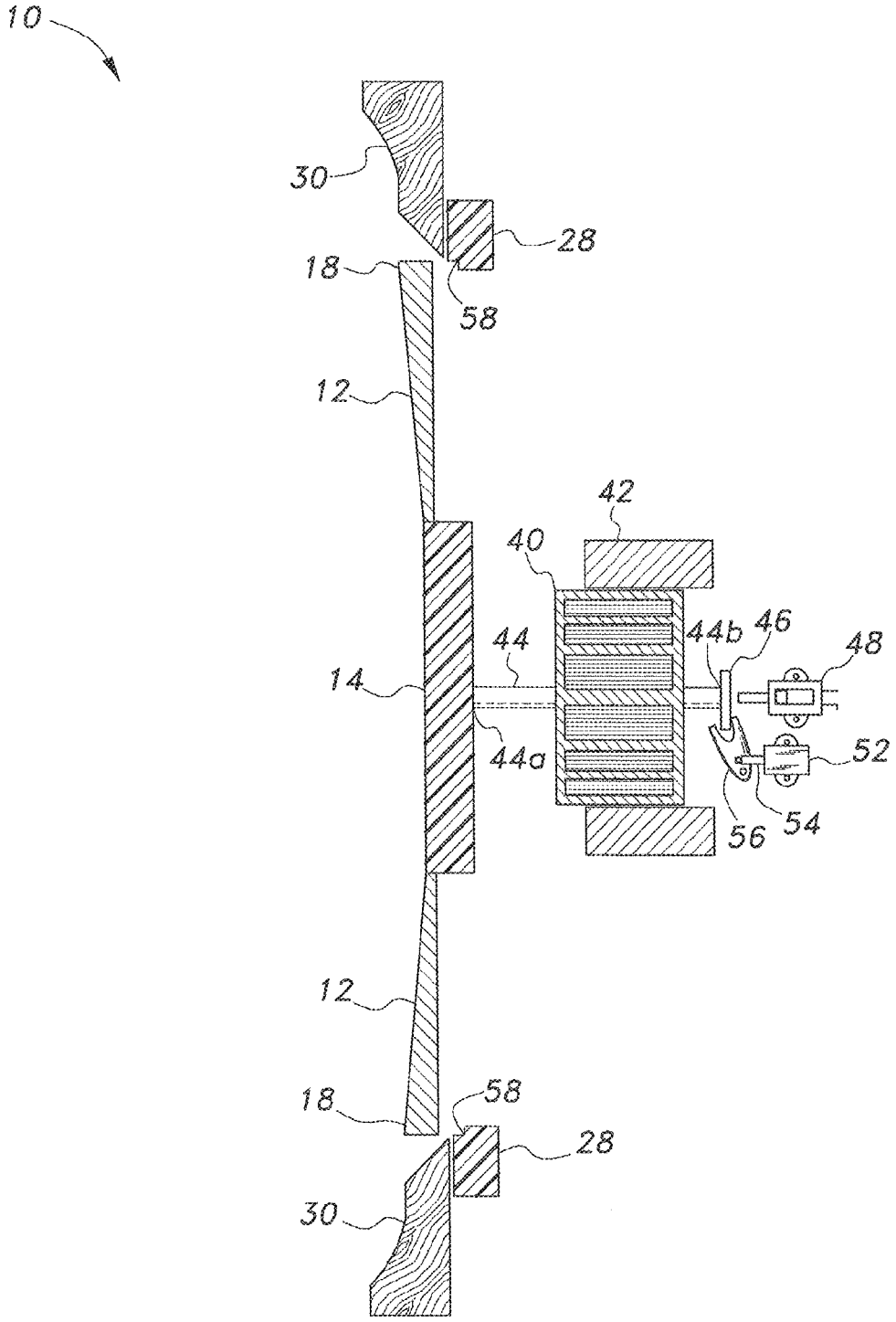
FIG. 3C is a side elevation view of the motor, fan, and shaft control mechanism of the ventilation fan with automatic blade closure mechanism according to the present invention, showing the blades in their fully deployed, positive or open pitch orientation as when the fan is operating.
Figure 4A:
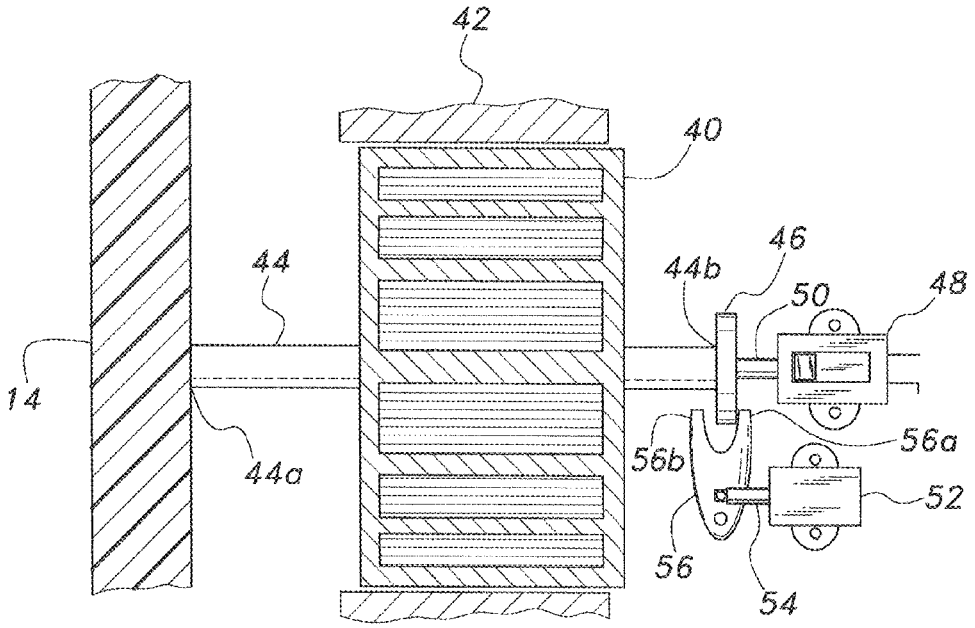
FIG. 4A is a detailed side elevation view of the shaft control mechanism of the ventilation fan with automatic blade control mechanism according to the present invention, showing the mechanism in the configuration of FIG. 3A.
Figure 4B:
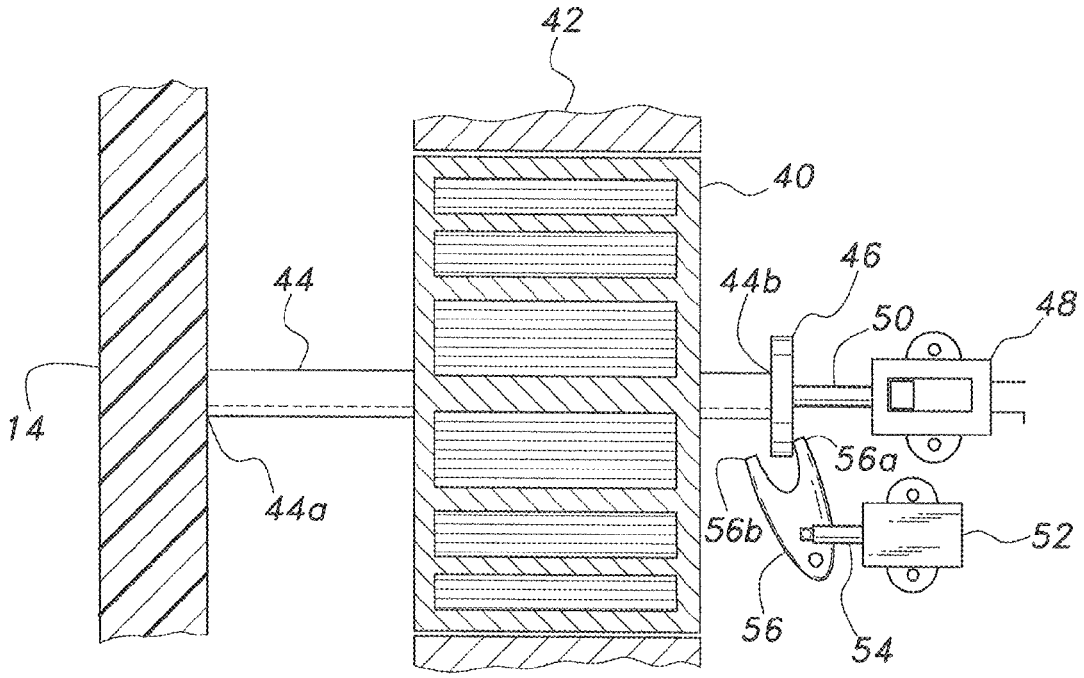
FIG. 4B is a detailed side elevation view of the shaft control mechanism of the ventilation fan with automatic blade control mechanism according to the present invention, showing the mechanism in the configuration of FIG. 3B.
Figure 4C:
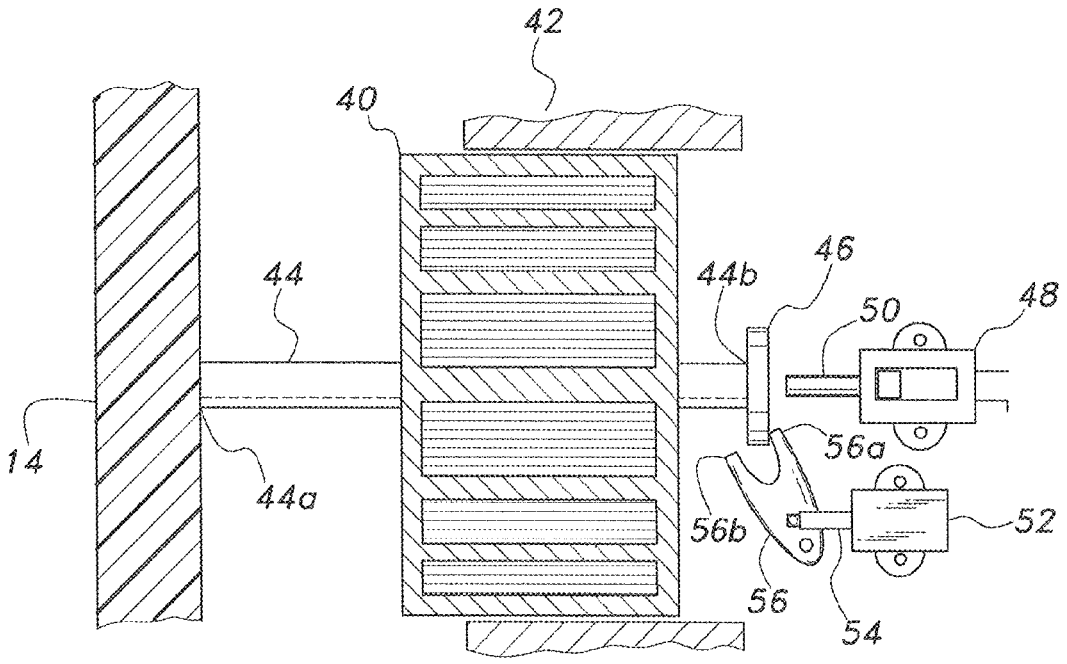
FIG. 4C is a detailed side elevation view of the shaft control mechanism of the ventilation fan with automatic blade control mechanism according to the present invention, showing the mechanism in the configuration of FIG. 3C.

FIGS. 3A, 3B, and 3C provide elevation views in section of the entire ventilation fan 10, with FIGS. 4A, 4B, and 4C providing more detailed views of the fan hub 14, motor and shaft, and actuating mechanism. The fan 10 is driven by a motor having a central rotor 40 that is surrounded by and rotates within a stationary stator 42. The rotor 40 is rotationally affixed to a shaft 44 that passes axially and concentrically therethrough, i.e., the shaft 44 rotates with the rotor 40. The shaft 44 includes a first end 44*a* to which the hub 14 is affixed, and an opposite second end 44*b* having a flange 46 affixed thereto.

A motor control switch 48 includes a spring biased, normally on or closed pushbutton or axial shaft 50 (shown more clearly in FIGS. 4A through 4C) that bears axially against the flange 46. This switch 48 is open, i.e., no electrical current flows therethrough, when the button or switch shaft 50 is retracted, as shown in FIGS. 4A and 4B. If additional clearance is provided between the switch 48 and the flange 46, the button or shaft 50 is extended (FIGS. 3C and 4C) and closes the switch 48 to operate the motor, the rotor 40 and stator 42, via conventional wiring (not shown). Thus, fan actuation is dependent upon axial movement of the shaft 44 relative to the motor control switch 48.

The axial movement of the shaft 44, and thus the stator 40, hub 14, and fan blades 12, is controlled by an actuator 52. The actuator 52 is most preferably a wax actuator type, having a wax core that is selectively heated by a conventional electrical circuit (not shown). An example of such a wax actuator is the Xpelair No. 40984SK, but other equivalent actuators may be used. Wax actuators operate on the principle of the application of heat to the wax core, which causes the wax to expand over a period of time. The expansion of the wax pushes an internal plunger or the like outward, thus extending its actuating shaft 54. In the case of the ventilation fan 10, the actuating shaft 54 is connected to a pivotally mounted shaft control link 56 that communicates with the flange 46 of the second end 44*b* of the shaft 44, via a pair of fingers 56*a* and 56*b* that extend to each side of the flange 46.

FIGS. 3A through 3C, and FIGS. 4A through 4C, provide progressive views showing the operation of the ventilation fan 10 from its inoperative state through its fully operative state. FIGS. 3A and 4A show the mechanism in its inoperative state, i.e., with no electrical power being applied to the apparatus. In this situation the wax actuator 52 is in its cold state, with the actuator rod or shaft 54 being fully retracted. This pivots the shaft control link 56 somewhat to the right, i.e., clockwise, resulting in the second finger 56*b* of the link 56 pushing or urging the flange 46 correspondingly to the right as shown in FIG. 3A. This draws the motor shaft 44, and attached rotor 40, hub 14, and blades 12 to the right as well, i.e., retracting the blades 12 so their tips 18 seat within a mating groove 58 within the frame 30 or the stationary surrounding field 28 of the fan 10. The result is that the chords of the blades 12 across their entire tips 18 are drawn flush within the groove 58, which along with the force of the tensile springs (FIGS. 2*a* through 2C) causes the blades 12 to assume a flat, zero pitch state as shown in FIGS. 1A, 1C, 2B, and 3A.

When electrical power is applied to the mechanism, the wax within the wax actuator 52 begins to expand. Electrical power is also applied to the motor control switch 48, but the switch 48 is held in its open or off position due to the shaft control link 56 until the wax expands sufficiently within the wax actuator 52. As the wax expands, the actuating shaft 54 of the actuator 52 extends, thereby causing the first finger 56*a* of the link 56 to push the flange 46 to the left as shown in FIGS. 3A through 3B, thus extending its shaft 44, rotor 40, hub 14, and fan blades 12 axially in the direction of the first end 44*a* of the shaft 44 to unseat the blade tips 18 from the surrounding groove 58. This intermediate step in the operation of the ventilation fan 10 is shown in FIGS. 3B and 4B. However, it will be noted in FIGS. 3B and 4B that the pushbutton shaft 50 of the motor control switch 48 is not fully extended, i.e., the end of the shaft 50 is still in contact with the flange 46. Thus, the motor control switch 48 remains open, and no power is being applied to the fan motor.

Finally, as the actuator 52 extends its actuating shaft 54 to its fullest extent, the shall control link 56 is pivoted further counterclockwise, causing the first finger 56*a* to push the shaft flange 46 further to the left, as viewed in FIGS. 3C and 4C. This allows the pushbutton contact 50 of the motor control switch 48 to extend to its fullest extent, allowing the switch 48 to close, thereby supplying electrical power to the fan motor. As the fan blades 12 begin to rotate, they overcome the forces of the tensile springs 36 (FIGS. 2A through 2C) and assume a positive pitch angle due to the aerodynamic forces acting upon them, as described further above. This opens the blades 12 to draw air therethrough for normal fan operation.

When fan operation is no longer desired, electrical power is removed from the motor control switch 48 and actuator 52. This may be accomplished conventionally by an automatically controlled thermostatic switch or the like, or by a conventional manually actuated switch. When power is removed from the fan motor and wax actuator 52, the fan stops rotating within a very short time. This results in the tensile springs 36 drawing the blades 12 to their flattened, zero pitch state, as shown in FIGS. 3B and 4B. However, the expanded wax within the actuator 52 continues to hold its shaft 54, and thus the flange 46 and its attached components, in an extended state in the direction of the first end 44*a* of the motor shaft 44 until the wax cools and contracts to some extent.

Finally, when the wax actuator 52 has cooled completely, its actuator shaft 54 is completely retracted into the actuator body, as shown in FIGS. 3A and 4A. This rotates the shaft control link to the right, or clockwise, from its orientation shown in FIGS. 3B and 4B to the orientation shown in FIGS. 3A and 4A. The motor shaft flange 46 is drawn to the right accordingly, with the rotor 40 of the fan motor, the motor shaft 44, hub 14, and fan blades 12 all being drawn to the right as viewed in FIGS. 3A through 4C. This results in the tips 18 of the fan blades 12 again seating within the surrounding groove or channel 58 of the stationary surrounding field 28 or frame 30 of the assembly, thereby completely closing off the air duct or vent opening 24 of the ventilation fan 10. The resulting closure of the fan blades 12 provides for the application of a unified pattern or display thereon, as exemplified by the decorative unified pattern or display 26 in FIG. 1C. Thus, the ventilation fan with blade closure mechanism 10 provides an attractive and unobtrusive appearance when not in operation.

It is to be understood that the present invention is not limited to the embodiments described above, but encompasses any and all embodiments within the scope of the following claims.

The invention claimed is:

1. A ventilation fan with automatic blade closure mechanism, comprising:

a motor having a central rotor and a stator surrounding the rotor;

a shaft extending axially through the rotor, the shaft having a first end and a second end opposite the first end, the shaft being rotationally affixed to the rotor;

a hub rotationally affixed to the first end of the shaft;

a plurality of fan blade spars extending radially from the hub, each of the fan blade spars being pivotally disposed upon the hub;

a fan blade affixed to each of the spars, each fan blade having a blade tip, each fan blade spar and corresponding fan blade selectively pivoting between a fan operative positive pitch angle and a fan inoperative flat pitch;

a stationary rim surrounding the fan blades, the rim defining a vent opening, the vent opening having a diameter substantially equal to a fan diameter, the fan blades substantially closing the vent opening when the ventilation fan is inoperative; and a fan blade pitch control mechanism whereby each fan blade pivots to a positive pitch angle when the ventilation fan is in operation, each fan blade further pivoting to a flat pitch when the ventilation fan is inoperative, wherein the fan blade pitch control mechanism comprises:

a spar extension extending radially from each fan blade spar;

a plurality of spring attachment blocks disposed upon the hub, each of the spring attachment blocks corresponding to one of the fan blade spars;

a tensile spring disposed between each of the spring attachment blocks and a corresponding spar extension, the springs urging the fan blades of the fan blade spars to a collectively closed, flat configuration; and an aerodynamic center of pressure disposed forward of each corresponding fan blade spar, each fan blade pivoting to a positive pitch angle during ventilation fan operation by means of the forwardly disposed aerodynamic center of pressure.

2. The ventilation fan with automatic blade closure mechanism according to claim 1, further comprising:

a shaft drive mechanism selectively extending the shaft axially in the direction of the first end of the shaft when the ventilation fan is operating, the shaft drive mechanism selectively retracting the shaft axially in the direction of the second end of the shaft when the ventilation fan is inoperative; and a blade tip groove disposed around the rim, the blade tips seating within the blade tip groove of the rim when the ventilation fan is inoperative.

3. The ventilation fan with automatic blade closure mechanism according to claim 1, further comprising:

a flange disposed upon the second end of the shaft;

a motor control switch communicating with the flange;

a shaft control link communicating with the flange; and an actuator communicating with the shaft control link, the actuator selectively driving the shaft control link axially relative to the shaft, the shaft control link selectively driving the flange and the shaft axially.

4. The ventilation fan with automatic blade closure mechanism according to claim 3, wherein the actuator is a wax actuator.

5. The ventilation fan with automatic blade closure mechanism according to claim 1, further comprising a decorative pattern disposed upon the fan blades and the hub, the decorative pattern forming a unified display as the fan blades close the vent opening when the ventilation fan is inoperative.

6. A ventilation fan with automatic blade closure mechanism, comprising:

a motor having a central rotor and a stator surrounding the rotor;

a shaft extending axially through the rotor, the shaft having a first end and a second end opposite the first end, the shaft being rotationally affixed to the rotor;

a shaft drive mechanism selectively extending the shaft axially in the direction of the first end of the shaft when the ventilation fan is operating, the shaft drive mechanism selectively retracting the shaft axially in the direction of the second end of the shaft when the ventilation fan is inoperative;

a hub rotationally affixed to the first end of the shaft;

a plurality of fan blade spars extending radially from the hub;

a fan blade affixed to each of the spars, each fan blade having a blade tip, the blade tips collectively defining a fan diameter;

a rim surrounding the fan blades, the rim defining a vent opening, the vent opening having a diameter substantially equal to the fan diameter, the rim further having a blade tip groove disposed therearound, the blade tips seating within the blade tip groove of the rim and the fan blades substantially closing the vent opening when the ventilation fan is inoperative; and a fan blade pitch control mechanism whereby each fan blade pivots to a positive pitch angle when the ventilation fan is in operation, each fan blade further pivoting to a flat pitch when the ventilation fan is inoperative, wherein the fan blade pitch control mechanism comprises:

a spar extension extending radially from each fan blade spar;

a plurality of spring attachment blocks disposed upon the hub, each of the spring attachment blocks corresponding to one of the fan blade spars;

a tensile spring disposed between each of the spring attachment blocks and a corresponding spar extension, the springs urging the fan blades of the fan blade spars to a collectively closed, flat configuration; and an aerodynamic center of pressure disposed forward of each corresponding fan blade spar, each fan blade pivoting to a positive pitch angle during ventilation fan operation by means of the forwardly disposed aerodynamic center of pressure.

7. The ventilation fan with automatic blade closure mechanism according to claim 6, wherein:

each of the fan blade spars is pivotally disposed upon the hub; and each fan blade spar and corresponding fan blade selectively pivots between a fan operative positive pitch angle and a fan inoperative flat pitch.

8. The ventilation fan with automatic blade closure mechanism according to claim 6, wherein the shaft drive mechanism comprises:

a flange disposed upon the second end of the shaft;

a motor control switch communicating with the flange;

a shaft control link communicating with the flange;

an actuator communicating with the shaft control link, the actuator selectively driving the shaft control link axially relative to the shaft, the shaft control link selectively driving the flange and the shaft axially.

9. The ventilation fan with automatic blade closure mechanism according to claim 8, wherein the actuator is a wax actuator.

10. The ventilation fan with automatic blade closure mechanism according to claim 6, further comprising a decorative pattern disposed upon the fan blades and the hub, the decorative pattern forming a unified display as the fan blades close the vent opening when the ventilation fan is inoperative.

11. A ventilation fan with automatic blade closure mechanism, comprising:

a motor having a central rotor and a stator surrounding the rotor;

a shaft extending axially through the rotor, the shaft having a first end and a second end opposite the first end, the shaft being rotationally affixed to the rotor;

a flange disposed upon the second end of the shaft;

a motor control switch communicating with the flange;

a shaft control link communicating with the flange;

a wax actuator communicating with the shaft control link, the wax actuator selectively driving the shaft control link axially relative to the shaft, the shaft control link selectively driving the flange and the shaft axially;

a hub rotationally affixed to the first end of the shaft;

a plurality of fan blade spars extending radially from the hub;

a fan blade affixed to each of the fan blade spars; and a fan blade pitch control mechanism whereby each fan blade pivots to a positive pitch angle when the ventilation fan is in operation, each fan blade further pivoting to a flat pitch when the ventilation fan is inoperative, wherein the fan blade pitch control mechanism comprises:

a spar extension extending radially from each fan blade spar;

a plurality of spring attachment blocks disposed upon the hub, each of the spring attachment blocks corresponding to one of the fan blade spars;

a tensile spring disposed between each of the spring attachment blocks and a corresponding spar extension, the springs urging the fan blades of the fan blade spars to a collectively closed, flat configuration; and an aerodynamic center of pressure disposed forward of each corresponding fan blade spar, each fan blade pivoting to a positive pitch angle during ventilation fan operation by means of the forwardly disposed aerodynamic center of pressure.

12. The ventilation fan with automatic blade closure mechanism according to claim 11, wherein:

each of the fan blade spars is pivotally disposed upon the hub;

each fan blade has a blade tip, the blade tips collectively defining a fan diameter, each fan blade spar and corresponding fan blade selectively pivoting between a fan operative positive pitch angle and a fan inoperative flat pitch; and a rim surrounds the fan blades, the rim defining a vent opening, the vent opening having a diameter substantially equal to the fan diameter, the fan blades substantially closing the vent opening when the ventilation fan is inoperative.

13. The ventilation fan with automatic blade closure mechanism according to claim 12, wherein the rim has a blade tip groove disposed therearound, the blade tips seating within the blade tip groove of the rim and the fan blades substantially closing the vent opening when the ventilation fan is inoperative.

14. The ventilation fan with automatic blade closure mechanism according to claim 11, further comprising a decorative pattern disposed upon the fan blades and the hub, the decorative pattern forming a unified display as the fan blades close the vent opening when the ventilation fan is inoperative.

* * * * *